US011351663B2

(12) United States Patent
McClung et al.

(10) Patent No.: US 11,351,663 B2
(45) Date of Patent: Jun. 7, 2022

(54) LATCHING HAMMER IMPACT WRENCH

(71) Applicant: Ingersoll-Rand Industrial U.S., Inc., Davidson, NC (US)

(72) Inventors: Mark T. McClung, Andover, NJ (US); Warren A. Seith, Bethlehem, PA (US)

(73) Assignee: INGERSOLL-RAND INDUSTRIAL U.S., INC., Davidson, NC (US)

( * ) Notice: Subject to any disclaimer, the term of this patent is extended or adjusted under 35 U.S.C. 154(b) by 32 days.

(21) Appl. No.: 16/726,349

(22) Filed: Dec. 24, 2019

(65) Prior Publication Data

US 2021/0187717 A1 Jun. 24, 2021

(51) Int. Cl.
*B25B 21/02* (2006.01)
*B25D 16/00* (2006.01)
*B25D 17/00* (2006.01)

(52) U.S. Cl.
CPC ..... *B25B 21/026* (2013.01); *B25B 21/02* (2013.01); *B25D 16/00* (2013.01); *B25D 17/005* (2013.01)

(58) Field of Classification Search
CPC ..... B25B 21/02–026; B25D 17/005; B25D 17/04; B25D 17/064; B25D 16/00–006
USPC ..... 173/48, 93.5, 93.6
See application file for complete search history.

(56) References Cited

U.S. PATENT DOCUMENTS 2,160,150 A * 5/1939 Jimerson ..... B25B 21/026 173/93.6
3,029,512 A * 4/1962 Saxton ..... B25D 5/02 30/367
3,181,626 A * 5/1965 Sussman ..... B25D 5/02 173/53
3,837,410 A * 9/1974 Maxwell ..... B25D 11/102 173/109
3,952,814 A * 4/1976 Gelfand ..... B25B 21/02 173/93
8,146,676 B2 * 4/2012 Zhang ..... B25B 21/00 173/48
9,114,514 B2 * 8/2015 Leong ..... B25B 21/026
9,539,715 B2 1/2017 McClung
9,597,784 B2 3/2017 McClung
9,993,916 B2 * 6/2018 Chen ..... B25B 21/02
10,583,544 B2 * 3/2020 Herr ..... B25D 11/08
2009/0194305 A1 * 8/2009 Xu ..... B25B 21/02 173/48
2010/0000750 A1 * 1/2010 Andel ..... B25B 21/02 173/48

(Continued)

*Primary Examiner* — Joshua G Kotis
(74) *Attorney, Agent, or Firm* — Kevin E. West; Advent, LLP

(57) ABSTRACT

An apparatus and method for latching a hammer of an impact tool, the hammer being displaceable along a cam shaft between a latched or retracted position and an impact position at which the hammer impacts an anvil. The apparatus can include one or more latching bodies, a portion of the one or more latching bodies being positioned within the hammer groove when the hammer is at the latched position, and removed from the hammer groove when the hammer is to be released from the latched position. The apparatus can also include an actuator sleeve that is configured to retain at least the portion of the one or more latching bodies within the hammer groove when the actuator sleeve is at the first position, and accommodate removal of the portion of the latching bodies from the hammer groove when the actuator sleeve is at a second position.

17 Claims, 8 Drawing Sheets

(56) References Cited

U.S. PATENT DOCUMENTS

| | | | | |
|---|---|---|---|---|
| 2012/0322605 | A1* | 12/2012 | Hirabayashi | B25F 5/001 475/149 |
| 2016/0052118 | A1* | 2/2016 | Rudolph | B25B 21/026 173/48 |
| 2020/0180128 | A1* | 6/2020 | Schneider | B25B 23/1475 |

* cited by examiner

LATCHING HAMMER IMPACT WRENCH

BACKGROUND

Embodiments of the present invention generally relate to impact tools. More particularly, but not exclusively, embodiments of the present invention relate to the latching and release of a hammer of an impact tool.

Certain types of impact tools, such as, for example, impact wrenches, can be selectively positioned by an operator to operably engage a mechanical fastener, such as a bolt or nut. Operation of such tools often involves using a force provided by a hammer impacting an anvil of the tool to facilitate rotation of the engaged mechanical fastener in a direction that can either tighten or loosen the mechanical fastener.

In at least an attempt to optimize the force generated by the impact tool, impact tools can often be designed such that the hammer of the impact tool is intended to impact the anvil at particular angles and axial positions. However, with such designs, if conditions are not optimal, the hammer can tend to arrive either prematurely or late to the position at which the hammer is to impact the anvil. Further, such optimal conditions can, among other factors, depend on the condition of the joint, such as the mechanical fastener, at which the tool is coupled. Accordingly, variances in the conditions in which the tool was designed to operate can adversely impact the efficiency of the tool, which can cause a reduction in the power that is delivered by the tool to the joint, as well as be potentially damage to the tool.

Accordingly, there remains a need for further contributions in this area of technology.

BRIEF SUMMARY

An aspect of the present application is an apparatus comprising a hammer having a hammer groove, the hammer being axially and rotatably displaceable along a cam shaft between a retracted position and an impact position. The apparatus can also include an anvil that is positioned to be impacted by the hammer when the hammer is displaced to the impact position. Additionally, the apparatus can include one or more latching bodies, a portion of the one or more latching bodies being positioned within the hammer groove when the hammer is at the retracted position, and the one or more latching bodies not being positioned within the hammer groove when the hammer is at the impact position. Further, the apparatus can include an actuator sleeve having a recess, the actuator sleeve being displaceable between a first position and a second position. The actuator sleeve can be configured to retain at least the portion of the one or more latching bodies within the hammer groove when the actuator sleeve is at the first position. Further, the recess is positioned to accommodate removal of the portion of the one or more latching bodies from the hammer groove when the actuator sleeve is at the second position.

An aspect of the present application is an apparatus comprising one or more latching bodies, and a hammer having a hammer groove and one or more hammer jaws, a portion of the one or more latching bodies being selectively received within, and removed from, the hammer groove. The apparatus can also include an anvil having one or more anvil jaws and an actuator sleeve that is displaceable between a first position at which the actuator sleeve assists in retaining the portion of the one or more latching bodies in the hammer groove, and a second position at which the actuator sleeve accommodates removal of the portion of the one or more latching bodies from the hammer groove.

Another aspect of the present application is a method comprising receiving a portion of a latching body into a hammer groove of a hammer to retain the hammer at a latched position, and determining whether a rotational velocity of the hammer while the hammer is retained at the latch position exceeds a threshold rotational velocity. Additionally, upon determining the rotational velocity exceeds the threshold rotational velocity, an actuator sleeve can be displaced from a first position at which the actuator sleeve assists in retaining the portion of the latching body in the hammer groove, to a second position at which the actuator sleeve accommodates removal of the portion of the latching body out of the hammer groove. Further, upon removal of the portion of the latching body out of the hammer groove, the hammer can be released along a cam shaft from the latched position to an impact positon, where the hammer can impact an anvil.

BRIEF DESCRIPTION OF THE DRAWINGS

The description herein makes reference to the accompanying figures wherein like reference numerals refer to like parts throughout the several views.

Figure 1:
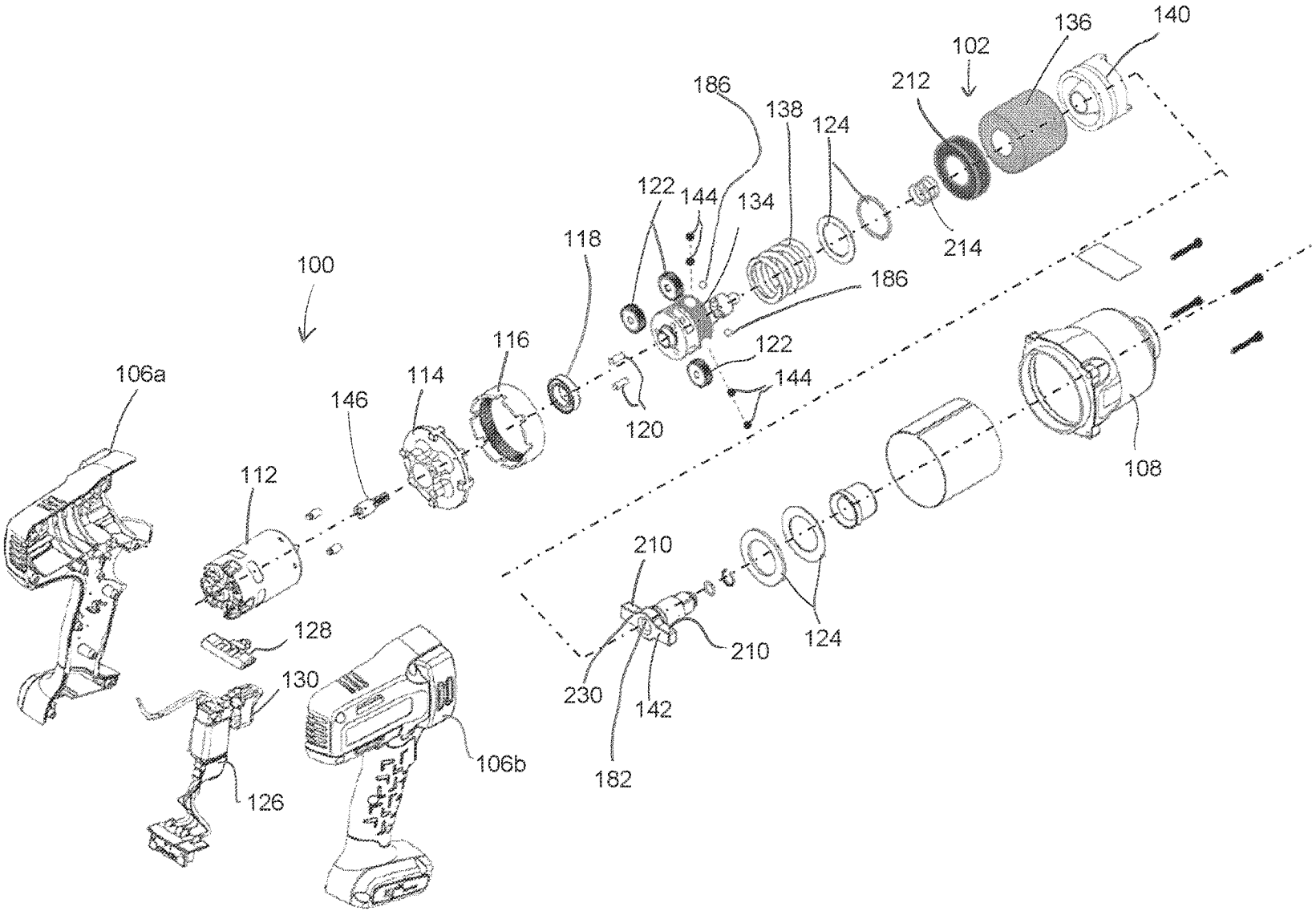
FIG. 1 illustrates an exploded view of an exemplary impact tool that includes an impact latch assembly according to an illustrated embodiment of the subject application.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

Figure 2:
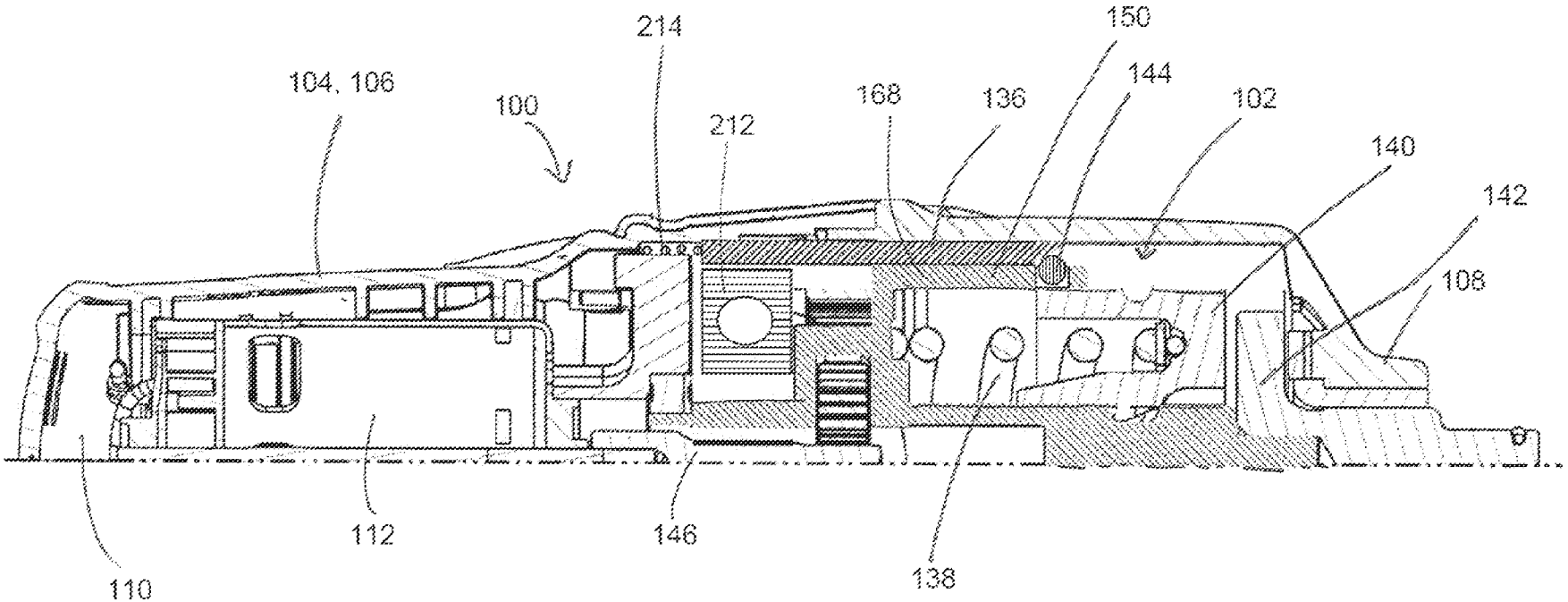
FIG. 2 illustrates a cross sectional view of a portion of the exemplary impact tool shown in FIG. 1.

FIGS. 1 and 2 illustrate exploded and cross sectional views, respectively, of at least a portion of an exemplary impact tool 100 that includes an impact latch assembly 102 according to an illustrated embodiment of the subject application. The exemplary embodiment illustrated in FIGS. 1 and 2 depicts the impact tool 100 in the form of an electrically operated cordless impact wrench. However, embodiments of the subject application can be utilized with a variety of different types of impact tools, as well as be used with a variety of different types of prime movers and energy sources. For example, embodiments of the subject application are applicable to at least hydraulically and electrically operated impact tools, including corded and cordless electrically operated impact tools, among other types of impact tools.

The impact tool 100 can include a housing 104 (FIG. 2) having a first portion 106, shown in FIG. 1 in separate halves 106*a*, 106*b*, that can be coupled to a second body portion 108 of the housing 104. When the housing 104 is assembled, the first body portion 106 and the second body portion 108 can generally define an inner region 110 (FIG. 2) of the tool 100. The inner region 110 can house at least a portion of a variety of components of the tool 100, including, for example, but not limited to, a prime mover 112, a ring gear holder 114, a ring gear 116, bearings 118, pins 120, planet gears 122, the impact latch assembly 102, washers 124, a trigger assembly 126, and a directional actuator 128. While FIG. 1 illustrates the prime mover 112 in the form of an electrical motor, as discussed above, embodiments of the subject application can be adapted for use with a variety of other types of prime movers. Further, as seen in FIG. 1, the first body portion 106 can provide a handle at which a user can both grip the tool, as well as engage an input device of the tool, such as, for example, a trigger 130 of the trigger assembly 126, among other input devices, to selectively control operation of the tool 100. According to certain embodiments, an end portion of the first body portion 106 can be configured to selectively engage a removable power supply 132, such as, for example, a rechargeable battery, that is operably coupled to at least the prime mover 112 such that the power supply 132 can provide electrical power to operate at least the prime mover 112.

According to certain embodiments, the impact latch assembly 102 can include a cam assembly 134, an actuator sleeve 136, a biasing element 138, a hammer 140, an anvil 142, and one or more latching bodies 144. According to embodiments in which the impact tool 100 is an impact wrench, the tool 100 is configured to accommodate rotational and axial displacement, also referred to as oscillation, of the hammer 140 as the hammer 140 is repeatedly displaced to a position at which the hammer 140 impacts the anvil 142. At least some of the energy from the hammer 140 impacting the anvil 142 can be transmitted to the bolt or nut, among other mechanical fasteners, that is coupled to the tool 100 in a manner that can facilitate at least a degree of rotation of the bolt or nut. Further, at least some of the energy from the hammer 140 impacting the anvil 142 can cause the hammer 140 to rebound or retract away from the anvil 142 such that, after impacting the anvil 142, the hammer 140 is axially and rotatably displaced in a direction that is opposite to the direction the hammer 140 had been traveling prior to impacting the anvil 142.

At least some of the rebound energy can be absorbed in a manner that can create, using the biasing element 138, a torsional spring that can allow the hammer 140 to have, relative to the associated prime mover 112, different relative angular and axial velocities at any given time. Such rebound energy can be sufficient to accommodate the hammer 140 at least clearing the anvil 142 such that the hammer 140 can again be rotatably displaced without interference from the anvil 142. Further, after impacting the anvil 142, the hammer 140 can be axially retracted away from the impact position until the rebound energy has generally been completely dissipated and/or absorbed. As discussed below, according to embodiments of the subject application, prior to the hammer 140 again being displaced to the impact position, the impact latch assembly 102 can retain the hammer 140 at a latched position, where the hammer 140 can remain until the hammer 140 reaches a threshold rotational velocity and/or a position relative to the anvil 142 that can facilitate jaws of the hammer 140, when the hammer 140 is released from the latched position, impacting the jaws of the anvil 142 at a location that can deliver a generally optimal amount of energy.

As indicated by FIGS. 1 and 2, according to the illustrated embodiment, the cam assembly 134 can be coupled to an output shaft 146 of, or which is coupled to, the prime mover 112 by a planetary gear set. The planetary gear set can include the ring gear 116 and a plurality of planet gears 122, and can function as a gear reduction system. According to such an embodiment, the output shaft 146 of the prime mover 112 provides power in the form of torque that, via operation of the planetary gear set, can be translated into at least rotational displacement of the cam assembly 134. Moreover, rotational power provided by the output shaft 146 of the prime mover 112 can facilitate rotational displacement of the planet gears 122 around the ring gear 116, which is translated into rotational displacement of the cam assembly 134. Alternatively, according to certain embodiments, the cam assembly 134 can be directly coupled to the output shaft 146 of the prime mover 112 such that power provided by the output shaft 146 is directly translated into rotational displacement of the cam assembly 134 without use of a gear reduction system. Further, the direction of rotational displacement of the cam assembly 134 can be based on the rotational direction of the output shaft 146, which can be controlled, at least in part, by the directional actuator 128. While the foregoing illustrates examples of manners in which the rotational power can from the output shaft 146 of the prime mover 112 can be transmitted to facilitate rotational displacement of the cam assembly 134, such power can be transmitted to the cam assembly 134 in a variety of other manners, including, but not limited to, use of different types of reducers and gearing arrangements and configurations.

Figure 3:
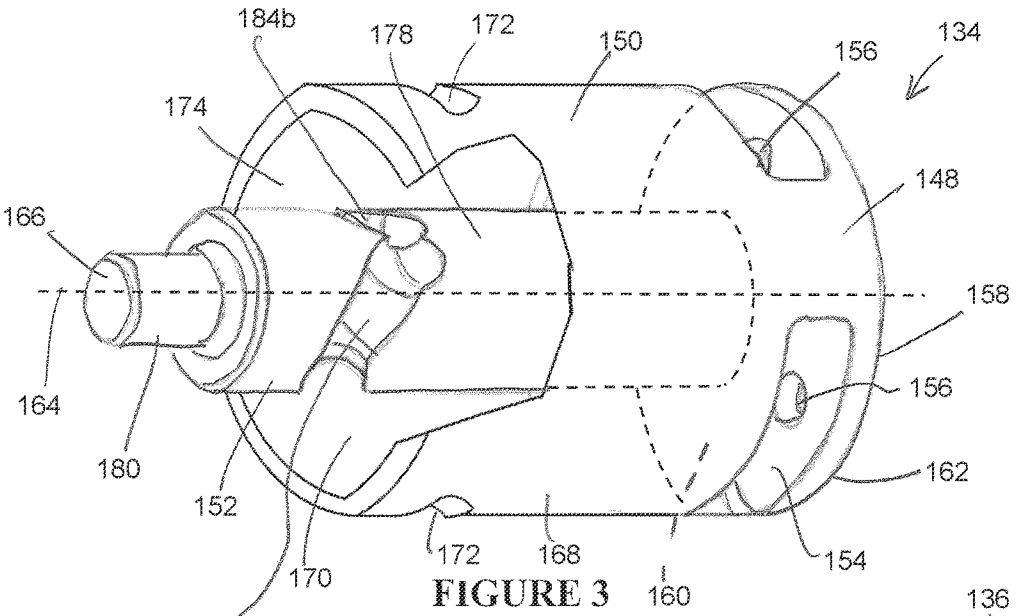
FIG. 3 illustrates a partial cutaway perspective view of an exemplary cam assembly according to an illustrated embodiment of the subject application.

FIG. 3 illustrates a partial cutaway perspective view of an exemplary cam assembly 134 according to an illustrated embodiment of the subject application. According to the illustrated embodiment, the cam assembly 134 includes a gear housing 148, a cam sleeve 150, and a camshaft 152. The gear housing 148 can include a cavity 154 that is positioned between upper and lower walls 158, 160 of the gear housing 148 at, or near, a first end 162 of the cam assembly 134. The cavity 154 can be sized to house at least a portion of the planet gears 122. The planet gears 122 can be secured to the gear housing 148 in a variety of different manners, including, for example, via pins 120 (FIG. 1) that can be inserted into apertures 156 in a upper wall 158 of the gear housing 148 and/or of the cam assembly 134 and about which the planet gears 122 rotate. At least a portion of the planet gears 122 can extend out of the cavity 154 through openings in the gear housing 148 such that, at least when the tool 100 is assembled, a portion of the planet gears 122 can be positioned to engage teeth of the ring gear 116.

The cam sleeve 150 can extend generally along a central longitudinal axis 164 of the cam assembly 134 from the gear housing 148, or, alternatively, from around the first end 162 of the cam assembly 134 and in a direction that is generally towards an opposing second end 166 of the cam assembly 134. Further, the cam sleeve 150 can have a wall 168 that generally defines an inner area 170 of the cam sleeve 150, the inner area 170 being sized to at least temporarily house at least a portion of the hammer 140. Additionally, the inner area 170 can extend through an open end 174 of the cam sleeve 150, as discussed below.

According to certain embodiments, the cam sleeve 150 can be sized, such as, for example, to have a length in a direction that is generally parallel to the central longitudinal axis 164, that can accommodate at least a portion of the cam sleeve 150 being positioned about at least a portion of the hammer 140 both when the hammer 140 is retracted away from the anvil 142 and when the hammer 140 impacts the anvil 142. Such sizing of the cam sleeve 150 can, according to at least certain embodiments, accommodate the cam sleeve 150 at least partially guiding the hammer 140 as the hammer 140 is oscillated along the camshaft 152. Further, while the cam sleeve 150 can have a variety of shapes and sizes, according to the illustrated embodiment the cam sleeve 150 has a generally cylindrical configuration.

One or more orifices 172 can extend through the wall 168 of the cam sleeve 150 such that the orifices 172 are at least in fluid communication with the inner area 170 of the cam sleeve 150. The orifices 172 are sized to accommodate at least linear displacement of one or more latching bodies 144 that can be used to at least temporarily retain or latch the hammer 140 at a latched position, as discussed below. According to certain embodiments, the cam sleeve 150 includes at least two orifices 172, each orifice 172 having a size, such as, for example, diameter, that is similar to a corresponding outer size of the latching bodies 144 such that the latching bodies 144 are at least linerally displaceable within the orifice 172 in a direction generally toward and away from the inner area 170 of the cam sleeve 150. According to the illustrated embodiment, each of the orifices 172 extend along an axis that is generally orthogonal to the central longitudinal axis 164 of the cam sleeve 150. Further, while the orifices 172 can be angularly positioned at a variety of locations about the cam sleeve 150, according to certain embodiments the orifices 172 can be separated equidistantly from other, adjacent orifices 172.

Figure 4A:
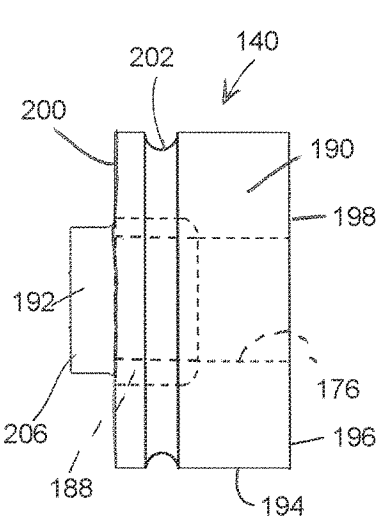
FIGS. 4A and 4B illustrate side and bottom views, respectively, of an exemplary hammer according to an illustrated embodiment of the subject application.

The camshaft 152 generally extends from the gear housing 148 to the second end 166 of the cam assembly 134 along the central longitudinal axis 164 of the cam assembly 134. Alternatively, according to embodiments in which the cam assembly 134 does not include the gear housing 148, the camshaft 152 generally extends from the first end 162 to the second end 166 of the cam assembly 134. According to the illustrated embodiment, a first portion 178 of the cam shaft 152 has a size, such as, for example, an outer diameter, that corresponds to a size of a bore 176 that extends through at least a portion of the hammer 140 (FIG. 4A). Additionally, a second portion 180 at an end of the camshaft 152 is sized to be matingly received in a cavity 182 (FIG. 1) of the anvil 142. Further, according to the illustrated embodiment, at least a portion of the first portion 178 of the camshaft 152 extends along the inner area 170 of the cam sleeve 150 and through the open end 174 of the cam sleeve 150, while the second portion 180 of the camshaft 152 is positioned outside of the inner area 170 of the cam sleeve 150.

Figure 5:
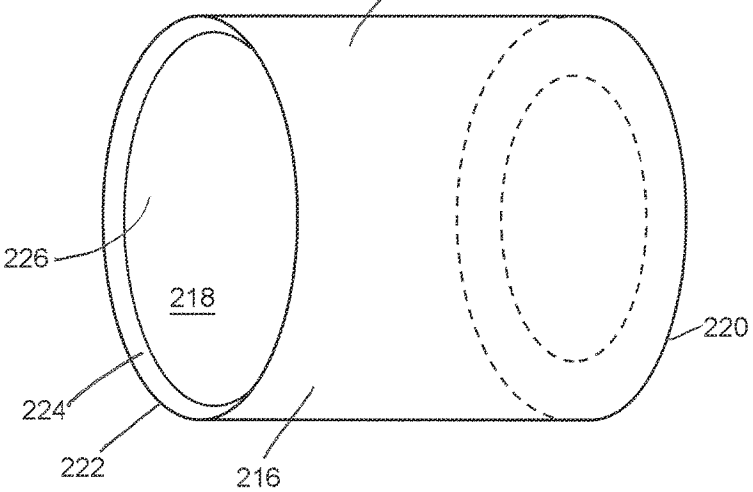
FIG. 5 illustrates a side perspective view of an exemplary actuator sleeve according to an illustrated embodiment of the subject application.

The first portion 178 of the camshaft 152 also includes one or more cam grooves 184 that receive one or more cam balls 186 (FIG. 5) that is/are also received within a ball recess 188 in the hammer 140 (FIG. 5). The cam grooves 184 and cam balls 186 can be used in connection with a ball and cam mechanism. Such a ball and cam mechanism can couple the hammer 140 to the camshaft 152, as well as guide oscillating movement of the hammer 140 in which the hammer 140 is rotatably and axially displaced along the camshaft 152. Further, such oscillating movement of the hammer 140 can occur along the central longitudinal axis 164 of the cam assembly 134 as the hammer 140 is displaced between the latched position and an impact position at which the hammer 140 impacts the anvil 142.

According to certain embodiments, the cam groove 184 comprises converging first and second cam grooves 184*a*, 184*b*, the first cam groove 184*a* providing a right handed helical groove, and the second cam groove 184 providing a left handed helical groove. Such a pair of opposing handed or threaded first and second helical cam grooves 184*a*, 184*b* can accommodate the hammer 140 oscillating along one of the helical cam grooves 184*a*, 184*b* when the output shaft 146 of the prime mover 112, and thus the hammer 140, are rotated in a first direction, such as, for example, in a clockwise direction, and accommodate the hammer 140 oscillating along the other of the helical grooves 184*a*, 184*b* when the output shaft 146, and thus the hammer 140, are rotated in a second, opposite direction, such as, for example, in a counter clockwise direction.

Figure 4B:
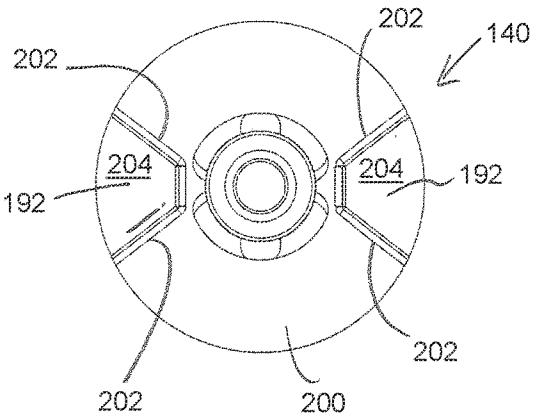

FIGS. 4A and 4B illustrate side and bottom views, respectively, of an exemplary hammer 140 according to an illustrated embodiment of the subject application. The hammer 140 can include a body portion 190 and one or more hammer jaws 192. While the body portion 190 can have variety of different shapes and configurations, according to the embodiment depicted in FIG. 4A, the body portion 190 has a generally cylindrical shape. Thus, according to the depicted embodiment, the body portion 190 can include a sidewall 194 that extends between a top wall 196 at a first end 198 of the hammer 140 and a bottom wall 200 of the body portion 190.

The sidewall 194 of the hammer 140 can include a hammer groove 202 that extends into at least a portion, as well as around the circumference, of the sidewall 194. The hammer groove 202 can be positioned and sized to selectively receive insertion of a portion of one or more of the latching bodies 144 when the hammer 140 is at the latched position, as well as accommodate removal of the received portions of the latching bodies 144 from the hammer groove 202 as the hammer 140 is unlatched and displaced away from the latched position, as discussed below. Thus, for example, according to embodiments in which the one or more of the latching bodies 144 are balls having a round or circular shape, the hammer groove 202 can have a similar rounded shape that extends to a depth into the sidewall 194 of the hammer 140 (as generally indicated by the "D" direction in FIG. 4A) that is less than the diameter of the latching bodies 144. Additionally, the hammer groove 202 can have a width (as generally indicated by the "W" direction in FIG. 4A) that corresponds to, if not is slightly larger than, the corresponding width of the widest portion of the latching bodies 144 that may extend into the hammer groove 202. Such a shape and configuration of the hammer groove 202 can at least assist in retaining a portion of the latching bodies 144 in the hammer groove 202 when the hammer 140 is latched at the latched position such that the latching bodies 144 are positioned to prevent axial displacement of the hammer 140. Further, such a configuration of the hammer groove 144 can assist in urging the latching bodies 144 out from the hammer groove 202 when the hammer 140 is being unlatched and at least axially displaced away from the latched position. Moreover, such a configuration for the hammer groove 202 can minimize the possibility that the latching bodies 144 may become inadvertently jammed, or otherwise partially stuck, in the hammer groove 202 when the hammer groove 202 is to be released from the latched position.

The axial location of hammer groove 202 and/or of the orifice(s) 172 along the wall 168 of the cam sleeve 150 can be based on variety of considerations. For example, according to certain embodiments, the hammer groove 202 of the hammer 140 and the orifices 172 in the wall 168 of the cam sleeve 150 can both be positioned such that the hammer 140 can be retained at a latch position that corresponds to the maximum distance that the hammer 140 can be axially retracted, via at least rebound energy, away from the anvil 142. Thus, according to such an embodiment, with the hammer 140 retracted to its furthest axial distance away from the anvil 142, the hammer groove 202 can be axially aligned with the orifices 172 in the cam sleeve 150 of the cam assembly 134 such that at least a portion of the latching bodies 144 can be displacement into the hammer groove 202 while also partially remaining within the associated orifice 172 of the cam sleeve 150, thereby providing an interference that prevents axial displacement of the hammer 140 such that the hammer 140 is retained at the latched position.

Alternatively, or additionally, according to certain embodiments, the hammer groove 202 and orifices 172 of the cam sleeve 150 can be positioned such that at least a portion of the latching bodies 144 can be displaced into hammer groove 202 in instances in which the hammer 140 is retracted to a position that is less than the furthest possible distance that the hammer 140 can be axially retracted from the anvil 142. For example, according to certain embodiments, the orifice(s) 172 of the cam sleeve 150 and the hammer groove 202 of the hammer 140 can be at axial positions corresponding to instances in which the hammer 140 is separated from the anvil 142 by around at least half of the maximum distance at which the hammer 140 can be axially retracted away from the anvil 142. Such configurations can, for example, account for applications in which rebound energy from the hammer 140 impacting the anvil 142 is less than may be attained by other applications. Additionally, such a configuration can also account for instances in which the resistance provided by the joint that is being impacted by the tool, such as, for example, a nut or bolt that is engaged by the tool 100, begins to loosen and the associated rebound energy thus decreases with the continued loosening of the joint. Moreover, such a positioning of the orifices 172 and the hammer groove 202 accommodates the hammer 140 still, in at least certain instances, being capable of being retained in the latched position as the rebound energy, and thus the degree of associated axial displacement attained by the hammer when being retracted, decreases.

As seen in at least FIG. 4B, each hammer jaw 192 of the hammer 140 includes at least opposing side faces 202 and a bottom face 204, and can extend away from the bottom wall 200 of the body portion 190 of the hammer 140 to a second end 206 (FIG. 4A) of the hammer 140. While the number of hammer jaws 192 can vary, according to certain embodiments the hammer 140 includes two hammer jaws 192. Further, each space separating adjacent hammer jaws 192 can be sized to accommodate placement of at least a portion of an anvil jaw 208 (FIG. 1) as the hammer jaw 192 is being both rotatably and axially displaced into a position at which a side face 202 of the hammer jaw 192 impacts an adjacent side face 210 of anvil jaw 208. Thus, the space between adjacent hammer jaws 192 can be larger than a corresponding width between opposing side faces 210 of the anvil 142 such that a portion of the anvil jaw 208 can be received into the space between the adjacent hammer jaws 192 as the hammer jaws 192 move into position to impact the anvil jaws 208.

Turning to the biasing element 138, according to certain embodiments the biasing element 138 is a spring that is positioned to at least provide a biasing force against the hammer 140. According to certain embodiments, the biasing element 138 can be positioned within at least a portion of the cam sleeve 150. Moreover, according to the illustrated embodiment, the biasing element 138 is positioned between the lower wall 160 of the gear housing 148 and the body portion 190 of the hammer 140. Further, the biasing element 138 can be configured to absorb energy as the hammer 140 is radially retracted from the impact position, as well as, when the hammer 140 has been unlatched from the latched position, release at least a portion of that absorbed energy as a force that pushes the hammer 140 generally toward the anvil 142 and the impact position.

FIG. 4 illustrates a side perspective view of an exemplary actuator sleeve 136 according to an illustrated embodiment of the subject application. The actuator sleeve 136 can be configured to be axially displaceable between first and second positons over at least a portion of the cam assembly 134 in a direction that is generally parallel to, if not along, the central longitudinal axis 164 of the cam assembly 134. Such axial displacement of the actuator sleeve 136 can be facilitated in a variety of different manners, including, for example, by operation of an actuator 212 (FIG. 1), including, but not limited to, a solenoid, that is operably coupled to the actuator sleeve 136 and/or a biasing force that can, for example, be provided by a latch spring 214 (FIG. 1) that is operably connected to the actuator sleeve 136.

According to the illustrated embodiment, the actuator sleeve 136 includes an outer wall 216 that generally defines an interior region 218 of the actuator sleeve 136. The interior region 218 can have a size, such as, for example, a diameter, that can accommodate placement of at least a portion of the cam assembly 134 within the interior region 218 of the actuator sleeve 136, and more specifically, placement of at least a portion of the cam sleeve 150 within the interior region 218 of the actuator sleeve 136. Additionally, the actuator sleeve 136 can have a length between a first end 220 and a second end 222 of the actuator sleeve 136 that can at least accommodate placement of the actuator sleeve 136 over at least a portion of the one or more orifices 172 in the cam sleeve 150. Such portions of the actuator sleeve 136 can, when positioned adjacent to the orifices 172, provide a barrier that can assist in retaining the one or more latching bodies 144 in the orifices 172, and thus within the hammer groove 202, when the hammer 140 is at the latched position.

According to certain embodiments, the outer wall 216 of the actuator sleeve 136 can also include one or more features that can at least assist in accommodating displacement of the latching bodies 144 out of the hammer groove 202, such as when the hammer 140 is to be released from the latched position. Further, such features of the actuator sleeve 136 can also be configured to at least assist in facilitating displacement of the latching bodies 144 into the hammer groove 202 when the hammer 140 is to be retained in the latched position. For example, the recess 224 can have a shape and configuration, such as, for example, be a tapered surface that extends along an angle from the inner surface 226 to the outer surface 228 of the outer wall 216 of the actuator sleeve 136, that, when operably aligned with at least the orifice(s) 172 in the cam sleeve 150, can provide a space at that can receive a portion of a latching bodies 144. The size of such a space that is provided by the recess 224 can be comparable to the distance the latching bodies 144 need to be displaced so that the latching bodies 144 are removed from the hammer groove 202, and thus so that the latching bodies 144 do not prevent the hammer 140 from being unlatched and axially displaced from the latched position.

Additionally, the recess 224 of the actuator sleeve 136 can have a shape that can assist the actuator sleeve 136, as the actuator sleeve 136 is being axially displaced and the hammer 140 is to be retained at the latched position, in providing a force that can urge the displacement of the latching bodies 144 toward the hammer groove 202. Such displacement of the actuator sleeve 136, which, according to certain embodiments can occur using a biasing force provided by the latch spring 214, can at least assist in linerally displacing the latching bodies 144 such that at least a portion of the latching bodies 144 are received in the hammer groove 202 while also at least partially positioned in the associated orifice 172 in the cam sleeve 150 so as to retain the hammer 140 at the latched position, and thus prevent axial displacement of the hammer 140 along the camshaft 152.

Figure 6:
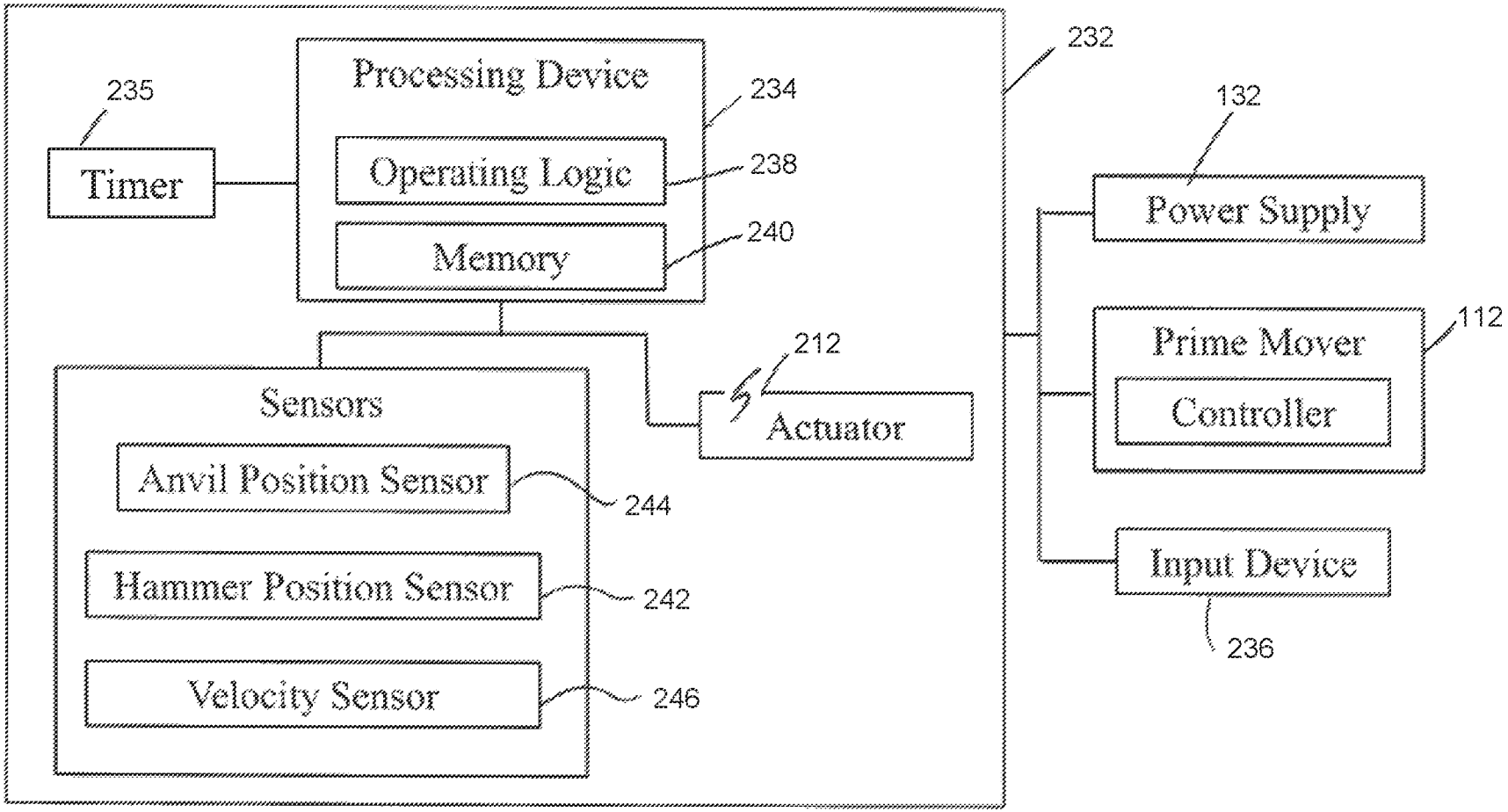
FIG. 6 illustrates an exemplary block diagram of a control system for an impact tool having an impact latch assembly according to an illustrated embodiment of the subject application.

FIG. 6 illustrates an exemplary block diagram of a control system 232 for operating the impact latch assembly 102. According to certain embodiments, at least a portion, if not all, of the control system 232 can be housed in the inner region 110 of the tool 100. Further, as seen in FIG. 6, the control system 232 can include a processing device 234, such as, for example, a programmable, dedicated, and/or hardwired state machine, or any combination thereof. Additionally, as shown in FIG. 6, the control system 232, including the processing device 234, can be communicatively coupled to a variety of components of the tool 100, including, for example, the prime mover 112 and/or a controller or microcontroller of the prime mover 112, including, for example, a motor controller. Additionally, the processing device 234 can also be communicatively coupled to one or more input devices 236, including, but not limited to the trigger assembly 126 and the directional actuator 128, which, again, can be configured to adjust the direction at which the prime mover 112 rotates the output shaft 146. Further, as indicated by FIG. 6, the control system 232 can, according to certain embodiments, receive electrical power from the same power supply 132 that provides electrical power for the prime mover 112.

The processing device 234 can include multiple processors, such as, for example, Arithmetic-Logic Units (ALUs), Central Processing Units (CPUs), Digital Signal Processors (DSPs), or the like. Processing devices 234 with multiple processing units can also utilize distributed, pipelined, and/or parallel processing. The processing device 234 may also be dedicated to performance of just the operations described herein or may be utilized in one or more additional applications.

In the depicted form, the processing device 234 is of a programmable variety that executes algorithms and processes data in accordance with operating logic 238 as defined by programming instructions (such as software or firmware) stored in the memory 240 of the control system 232. Alternatively or additionally, the operating logic 238 is at least partially defined by hardwired logic or other hardware. The processing device 234 can include one or more components of any type suitable to process the signals received from, for example, the trigger assembly 126 and one more ore sensors, among other devices, and to provide desired output signals, such as, for example, signals to the actuator 212 that can facilitate displacement of the actuator sleeve 136, signals for an output device, such as, for example, a display or light source, and/or signals for other aspects of the tool 100. Such components can also include digital circuitry, analog circuitry, or a combination of both.

The memory 240 can be included with the processing device 234 and/or coupled to the processing device 234. Further, the memory 240 can be of one or more types, such as a solid-state variety, electromagnetic variety, optical variety, or a combination thereof. Additionally, the memory 240 can be volatile, nonvolatile, or a combination thereof, and some or all of the memory 240 can be of a portable variety, such as a disk, tape, memory stick, cartridge, or the like. In addition, according to certain embodiments, the memory 240 can store data that is manipulated by the operating logic 238 of processing device 234, such as data representative of signals received from and/or sent to the actuator 212 and/or sensors, in addition to, or in lieu of, storing programming instructions defining the operating logic 238.

According to certain embodiments, the processing device 234 and the memory 240 can be attached to an electronic board that is positioned within at least the inner region 110 of the tool 100. According to at least certain embodiments, the electronic board is a printed circuit board (PCB), and thus is constructed from materials that are generally associated with PCBs. The electronic board can be secured to, and/or within, the inner region 110 of the tool 100 in a variety of manners, including, but not limited to, mechanical fasteners, such as bolts or screws, or snap-fit connections, among other manners of fastening the electronic board to the housing 104.

The processing device 234 can control operation of the actuator 212, and thus the timing of displacement, and associated positioning, of the actuator sleeve 136. As previously discussed, such displacement of the actuator sleeve 136 can at least assist in controlling when the latching bodies 144 can be removed from the hammer groove 202, and thus when the hammer 140 can be unlatched from the latched position. The timing of displacement of the actuator sleeve 136 by operation of the processing device 234 can thus be based on a variety of criteria, including criteria relating to the timing, position, and location at which the hammer jaw(s) 192 will impact the anvil jaw(s) 208. Thus, for example, according to certain embodiments, the processing device 234 can be configured to time the displacement of the actuator sleeve 136, and thus the unlatching of the hammer 140 from the latched position, based on certain predetermined criteria, including for example, at a time that the processing device 234 anticipates that based on the detected angular position of the hammer 140 relative to the detected angular position of the anvil 142, the impact between the hammer 140 and anvil 142 will be between side faces 202 of the hammer 140 and side faces 210 of the anvil 142 and that such impact will occur when the hammer 140 has generally been fully axially displaced away from the latched position. Such determination by the processing device 234 can also include releasing the hammer 140 from the latched position at a time at which, as the hammer 140 is being both rotatably and axially displaced, will minimize the likelihood that the hammer jaw(s) 192 will land on the top wall 230 of the anvil 142, have a reduced likelihood that a corner of the hammer jaw(s) 192 will hit a corner of the anvil jaw(s) 208, and/or prevent the hammer j aw(s) 192 from impacting the anvil jaw(s) 208 prior to the hammer 140 being completely axially displaced away from the latched position.

The processing device 234 can use a variety of information to determine when the actuator 212 is to displace the actuator sleeve 136, and thus when the hammer 140 is to be released from the latched position. For example, the processing device 234 can use information relating to the rotational velocity of the hammer 140, the angular position (s) of the hammer 140 and/or anvil 142, and/or the distance that the hammer 140 is to be axially displaced to reach the impact position, in connection with determining when to displace the actuator sleeve 136 and/or to release the hammer 140 from the latched position. The timing of the release of the hammer 140 from the latched position can also be based on other criteria, including, for example, whether the hammer 140 is rotating at or above a certain velocity threshold. Thus, for example, the processing device 234 may wait until the hammer 140 has reached a predetermined rotational velocity, which may be programmed into the control system 232 or determined via an input by the user, such that, when the hammer 140 is released from the latched position, the hammer 140 can deliver a generally optimal amount of energy as the hammer 140 impacts the anvil 142.

For example, according to certain embodiments, the control system 232 can include one or more sensors 242, 244, 246 that are communicatively coupled to the processing device 234, and which can provide an indication of, or information that can be used to calculate, the angular position of the anvil 142 and/or anvil jaw(s) 208, the angular position of the hammer 140 and/or hammer jaw(s) 192, the velocity of the current rotational displacement of the hammer 140, and/or the relative angular positions of the anvil 142 and hammer 140 and/or of their associated jaws 202, 210. A variety of different types of sensors can be used to determine such angular positions and/or velocity information, including, but not limited to position sensors, velocity sensors, hall effect sensors, accelerometer sensors, and/or gear tooth sensors, among other types of sensors. Additionally, rather than being directly derived, at least certain types of information can be derived using information from a sensor in combination with other information. For example, according to certain embodiments, information provided by, or otherwise collected from the hammer position sensor 242 and/or the anvil position sensor 244, indicating an angular position of the hammer 140 and/or anvil 142, can be used with information provided from a timer 235 to determine the rotational velocity of the hammer 140 and/or anvil 142, respectively.

For example, according to certain embodiments, the hammer 140 can have a serrated surface, such as, for example, a plurality of serrations, that can represent gear teeth. According to such an embodiment, the hammer position sensor 242 can comprise an integrated based circuit (IC) sensor that is positioned between the serrations on the hammer 140 and an imbedded magnet such that the IC sensor can detect variations in flux associated with the serrations passing by the IC sensor as the hammer 140 rotates. Such detection in flux variations can be used by the IC sensor of the hammer position sensor 242, the processing device 234, or another component of the control system 232 to determine an angular position of the hammer 140, which can be associated to an angular position of the hammer jaw(s) 192. Further, as previously discussed, such information can be used by the processing device 234 with other information, including, for example, the angular position of the anvil 142 and/or velocity of the hammer 140, to determine when the hammer 140 is to be released from the latched position.

With respect to the anvil position sensor 244, according to certain embodiments, the anvil position sensor 244 can be similar to, and thus have a similar construction, as the above discussed hammer position sensor 242. Alternatively, according to other embodiments, the anvil position sensor 244 can be a pickup sensor comprising a magnet that is attached to the anvil 142 and an IC based sensor that is mounted to another portion of the control system 232, including, but not limited to, the above-discussed printed circuit board of the control system 232. According to certain embodiments, the IC based sensor of the pickup sensor can detect and/or count pole pairs of the magnet, and such information can then be used, such as, for example, by the processing device 234, to determine the angular position of the anvil 142.

Figure 7:
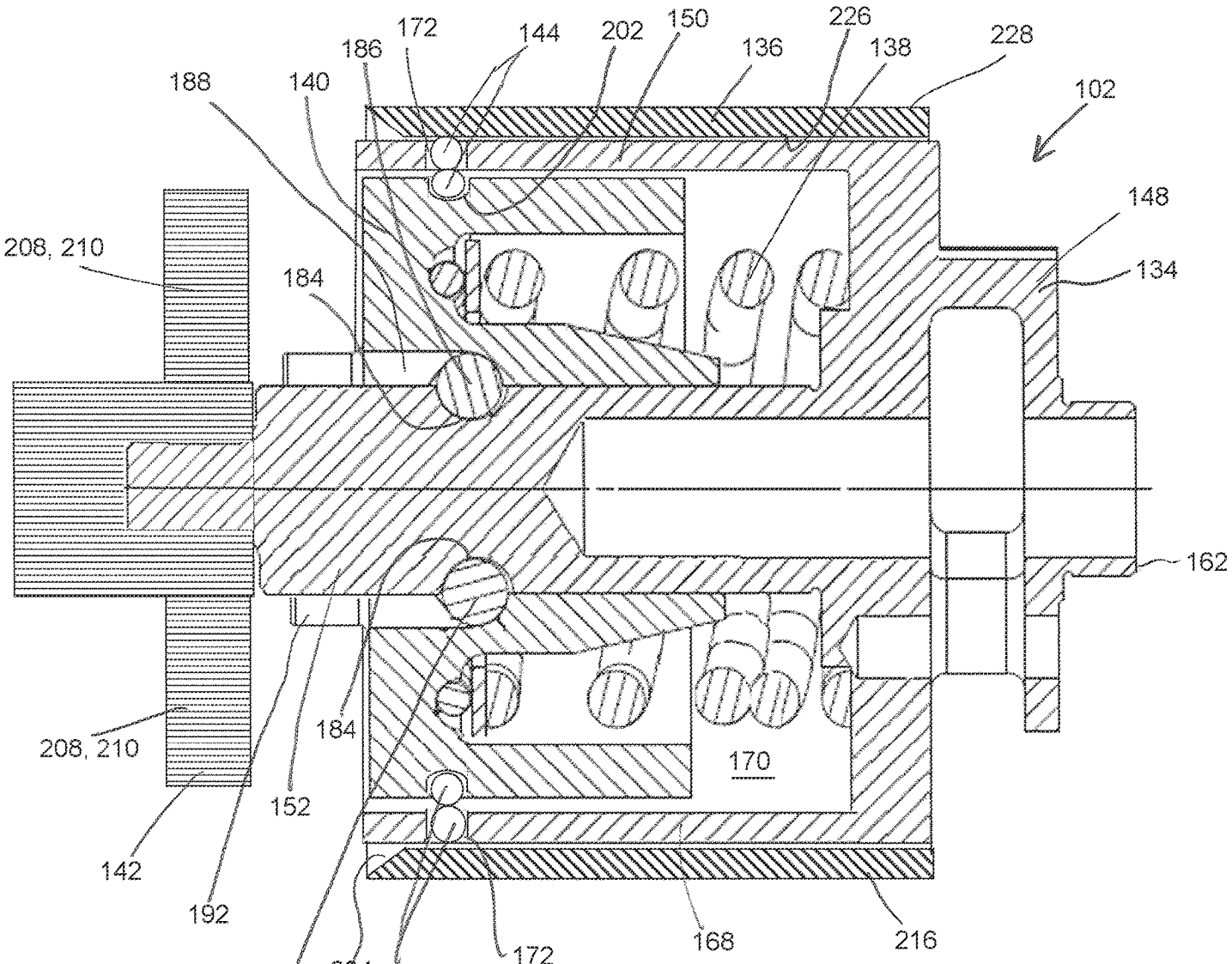
FIG. 7 illustrates a cross sectional view of an exemplary impact latch assembly coupled to an anvil according to an illustrated embodiment of the subject application, with a hammer of the impact latch assembly at a latched position.

FIG. 7 illustrates a cross sectional view of an exemplary impact latch assembly 102 coupled to the anvil 142 according to an illustrated embodiment of the subject application. Further, FIG. 7 depicts the hammer 140 of the impact latch assembly 102 at the latched position. As shown, with the hammer 140 at the latched position, the hammer groove 202 of the hammer 140 is axially aligned with the orifices 172 in the cam sleeve 150 such that at least a portion of the latching bodies 144 extend from the orifices 172 in the cam sleeve 150 and into the hammer groove 202. As also shown, with the hammer 140 at the latched position, the actuator sleeve 136 is at a first position at which the portion of the actuator sleeve 136 that is positioned adjacent to the orifices 172 in the cam sleeve 150 is configured to prevent the latching bodies 144 from being displaced out of the hammer groove 202. According to certain embodiments, the actuator sleeve 136 can be biased to the first position by a biasing force provided by the latch spring 214.

Further, as shown, when the hammer 140 is at the latched position, the hammer jaws 192 are at an axial position such that the hammer jaws 192 do not contact the anvil 142. The distance that the hammer jaws 192 are axially separated from the anvil 142 can be based on the relative axial positions of the hammer groove 202 of the hammer 140 and the orifices 172 of the cam sleeve 150, and thus the location of the hammer 140 when the hammer 140 is at the latched position. As previously discussed above, the axial location of the latch position can be based on a number of criteria, including, for example, the maximum, or, alternatively, less than maximum, axial distance that the hammer 140 can be expected to be retracted by rebound energy after impacting the anvil 142.

Additionally, during operation of the tool 100, while the hammer 140 is at the latched position, the hammer 140 can be rotatably displaced by the rotation of the camshaft 152. Moreover, as previously discussed, according to the illustrated embodiment, the hammer 140 can be coupled to the camshaft 152 via, for example, at least the operable engagement between the cam ball(s) 186, which are operably positioned within the hammer 140, and the cam groove 184 of the camshaft 152. Thus, as the cam assembly 134, and thus the camshaft 152, are rotated via direct or indirect coupling to the output shaft 146 of the prime mover 112, the hammer 140 can also be rotated while being in the latched position.

As previously discussed, as the hammer 140 rotates while at the latched positon, the processing device 234 can receive information from one or more sensors, including, for example, the hammer position sensor 242, anvil position sensor 244, and/or hammer velocity sensor 246, among other sensors, that can provide, or be used to determine, the angular positions of the hammer and anvil 142, and the rotational speed of the hammer 140. The processing device 234 can then determine whether the hammer 140 is being rotated at a velocity that meets or exceeds a predetermine threshold velocity. Additionally, when the velocity of the hammer 140 satisfies the threshold velocity, the processing device 234 can determine, based on at least actual and/or predicted angular positions of the hammer 140 and anvil 142 if, or when, to release the hammer 140 from the latched position such that the hammer 140 can be both rotatably and axially displaced to a positon at which side faces 202 of the hammer jaws 192 may impact side faces 210 of the anvil 142 while the hammer 140 has completed, or is competing, the full distance of its axial displacement to its impact position.

Figure 8:
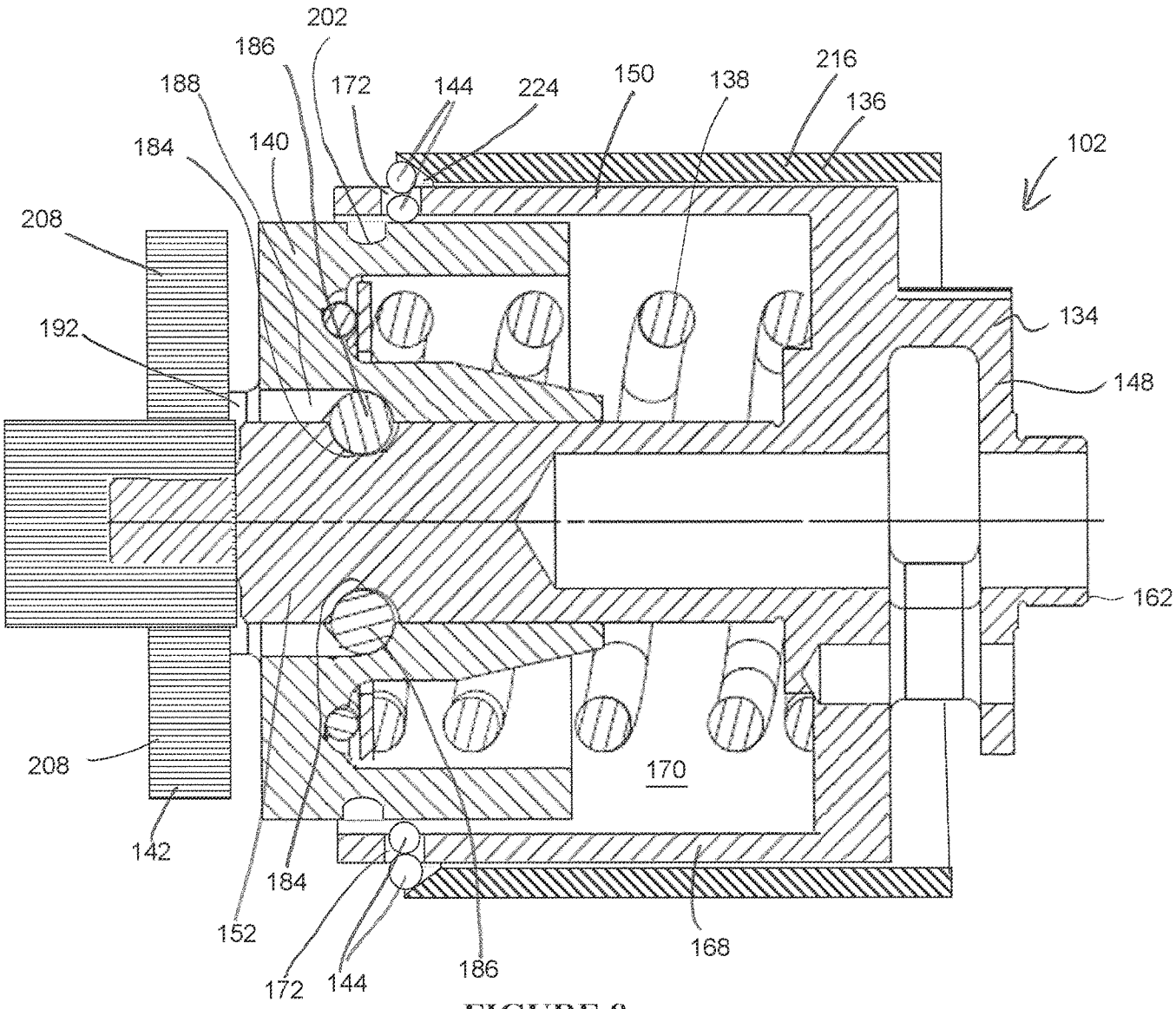
FIG. 8 illustrates a cross sectional view of the impact latch assembly shown in FIG. 7 with the hammer at an impact position relative to an anvil.

Upon determining that the hammer 140 is to be released from the latched position, the processing device 234 can generate a signal that is used to operate the actuator 212. The actuator 212, which is coupled to the actuator sleeve 136, can provide a force that overcomes the biasing force of the latch spring 214 and can displace the actuator sleeve 136 from the first position, to a second position (FIG. 8). As the actuator sleeve 136, is displaced, the recess 224 of the actuator sleeve 136 is axially moved to a position at which the space provided by the recess 224 of the actuator sleeve 136 is adjacent to the orifices 172 in the cam sleeve 150, thereby providing an area to receive a portion of the latching bodies 144.

With the recess 224 of the actuator sleeve 136 positioned to receive a portion of the latching bodies 144 through the adjacent orifice 172, the latching bodies 144 can be urged out of, and/or away from, the hammer groove 202 such that the hammer 140 can be released from the latched position. Such urging of the latching bodies 144 can be achieved in a variety of manners. For example, according to the illustrated embodiment, the biasing element 138 of the impact latch assembly 102 can provide a force that at least axially urges the hammer 140 toward the anvil 142. Such force, as well as the shaped of the hammer groove 202, such as, for example, a curved shape that generally conforms to at least a portion of an outer curved or rounded shape of the adjacent portion of the latching bodies 144, can facilitate the latching bodies 144 being pushed out from the hammer groove 202 as the hammer groove 202 is being axially displaced toward the anvil 142. Further, with the hammer 140 unlatched, the hammer 140 can be rotatably and axially displaced along the camshaft 152, and via use of the cam ball(s) 186 and cam groove(s) 184*a*, 184*b* and biasing element 138, to the impact positon, at which the hammer jaws 192 can impact the anvil jaws 208.

FIG. 8 illustrates a cross sectional view of the impact latch assembly 102 shown in FIG. 7 with the hammer 140 at the impact position relative to the anvil 142. As indicated by FIG. 8, when the hammer 140 is displaced from the latched position, as well as when the hammer 140 is at the impact position, the body portion 190 of the hammer 140 can be configured and positioned to prevent the latching bodies 144 from passing out of the orifice 172 and into the inner area 170 of the cam sleeve 150. Thus, with the hammer 140 at the impact positon, the latching bodies 144 can be retained within at least the orifices 172 of the cam sleeve 150 and between the recess 224 of the actuator sleeve 136 and the body portion 190 of the hammer 140.

Following the hammer jaws 192 impacting the anvil jaws 208, the rebound energy can, as previously discussed, cause the hammer 140 to be rotated in an opposite direction, as well as cause the hammer 140 to be axially retracted away from the anvil 142. If the rebound energy is at least sufficient to accommodate the hammer 140 being axially displaced to a location at which the hammer groove 202 is again aligned with the orifices 172 in the cam sleeve 150, if not in excess of such energy, the hammer 140 can again return to the latched position. Moreover, upon the hammer groove 202 returning to a position at which the hammer groove 202 is generally aligned with the orifices 172 of the cam sleeve 150, the shape and configuration of the recess 224 of the actuator sleeve 136 can, as the biasing force of the latch spring 214 facilitates axial displacement of the actuator sleeve 136 back to the first position, result in the actuator sleeve 136 pushing or otherwise linearly displacing at least a portion of the latching bodies back into the hammer groove 202. With the latching bodies 144 in the hammer groove 202, the actuator sleeve 136 can again be at a position at which the portion of the actuator sleeve 136 that is adjacent to the orifices 172 in the cam sleeve 150 assists in preventing the latching bodies 144 from being removable from the hammer groove 202, and thereby assist in retaining the hammer 140 in the latched position.

In the event the rebound energy is not sufficient to axially displaced the hammer 140 to a position at which the latching bodies 144 can enter into the hammer groove 202, or in the event the hammer 140 is not retained in the latched position, the hammer 140 can, upon completion of the biasing element 138 absorbing rebound energy, again be displaced toward the impact. However, whether side faces 202 of the hammer jaw 192 then impact side faces 210 of the anvil jaws 208, or whether the hammer jaws 192 impact other portions of the anvil 142, and whether such impact occurs prematurely with respect to the axial displacement of the hammer 140 can be dependent on numerous factors and conditions that may not have been at issue had the hammer 140 between retained at, and timely released from, the latched position by the impact latch assembly 102.

Figure 9:
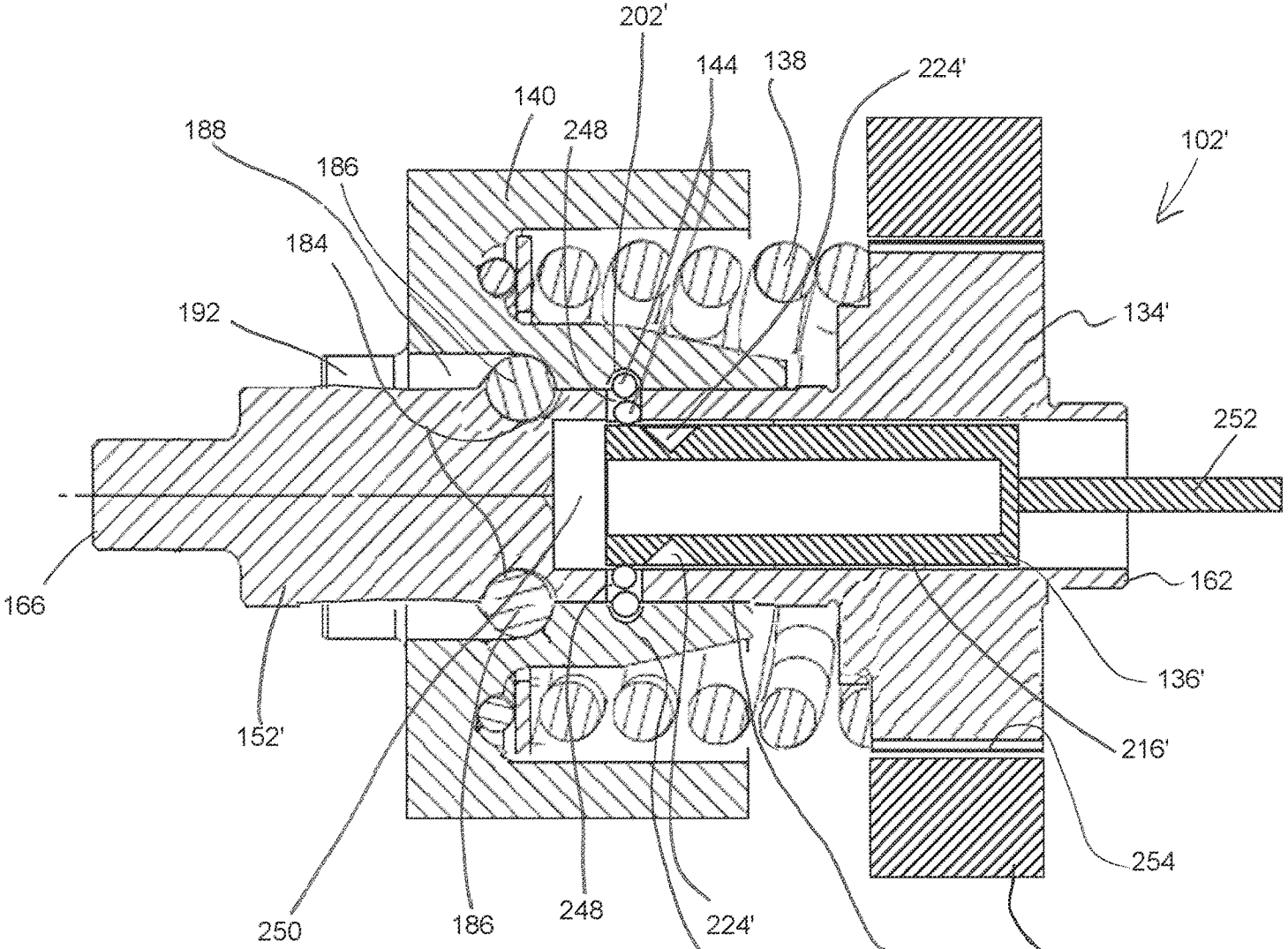
FIG. 9 illustrates a cross sectional view of an exemplary impact latch assembly according to an illustrated embodiment of the subject application, with a hammer of the impact latch assembly at a latched position.
Figure 10:
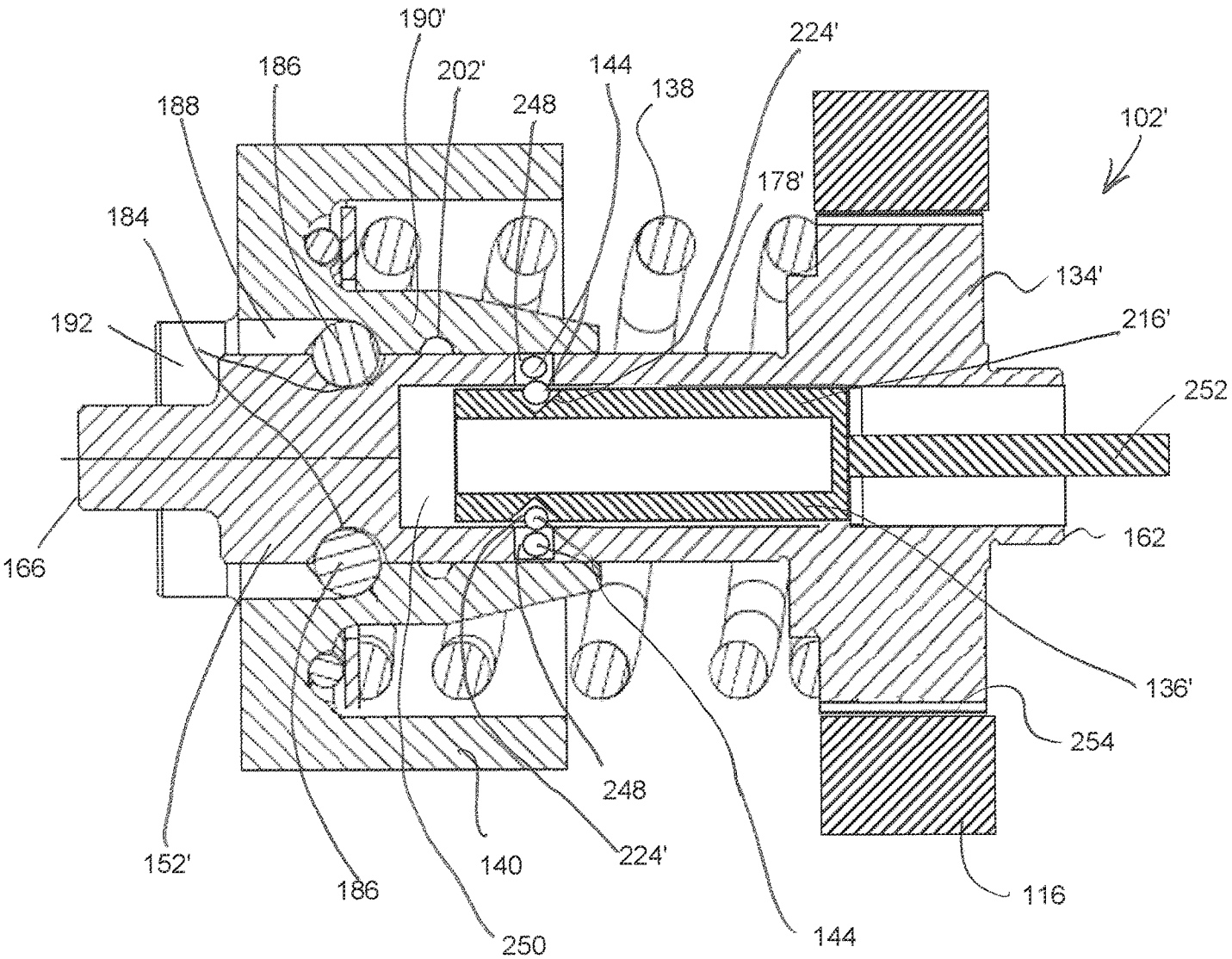
FIG. 10 illustrates a cross sectional view of the impact latch assembly shown in FIG. 9 with the hammer at an impact position.

FIGS. 9 and 10 illustrate an impact latch assembly 102' according to an alternative embodiment. As seen, FIG. 9 depicts a cam assembly 134' in which, in lieu of a cam sleeve 150, individual orifices 248 that are positioned within the first portion 178' of the camshaft 152'. Accordingly, rather than having an external actuator sleeve 136, as shown in at least FIGS. 7 and 8, the impact latch assembly 102' can include a central or internal actuator sleeve 136' that is positioned, and axially displaceable within, at least an interior portion 250 of the camshaft 152'. Thus, as shown, according to such an embodiment, the outer wall 216' of the actuator sleeve 136' can include one or more recesses 224' that can be selectively positioned to be generally aligned with the orifices 248 in the camshaft 152'. Further, rather than having an external hammer groove 202, as discussed with respect to at least FIGS. 7 and 8, the embodiment depicted in FIGS. 9 and 10 includes a hammer 140' having an internal hammer groove 202'. According to the illustrated embodiment, the internal hammer groove 202' can be in fluid communication with the bore 176' of the hammer 140', which, again, can be positioned around about the first portion 178' of the camshaft 152'.

As shown in FIG. 9, when the hammer 140' is at the latched position, the one or more latching bodies 144 can be at least partially positioned within orifices 248 in the camshaft 152', as well as extend a depth into the internal hammer groove 202' so that the latching bodies 144 are positioned to at least assist in retaining the hammer 140' at the latched position. Additionally, as shown in FIG. 9, the actuator sleeve 136' can be at a first position so that the portion of the outer wall 216' of the actuator sleeve 136' adjacent to the orifice 248 in the camshaft 152' has a size, such as, for example, a diameter, that prevents the latching bodies 144 from being linerally displaced so that the latching bodies 144 remain within at least the hammer groove 202', as well as the orifices 248. Similar to the actuator sleeve 136 discussed above with respect to FIGS. 7 and 8, the actuator sleeve 136' shown in at least FIG. 9 can, according to certain embodiments, be biased to the first position, such as, for example, by the previously discussed latch spring 214.

When the hammer 140' is to be released from the latched position so that the hammer 140' can be both axially and rotatably displaced along the camshaft 152' to the impact position, as shown in FIG. 10, the actuator sleeve 136' can be axially displaced from the first position to the second position, as seen in FIG. 10. Similar to the embodiments discussed above with respect to FIGS. 6-8, such displacement of the actuator sleeve 136' can be facilitated by the processing device 234 determining, based on information regarding at least the annular positions of the hammer 140' and anvil 142, as well as information regarding the velocity of the hammer 140', when the hammer 140' is to be released from the latched position. Thus, when the hammer 140' is to be released, the processing device 234 can, similar to the above discussed embodiments, generate a signal that results in operation of the actuator 212, which again is operably coupled to the actuator sleeve 136'. The actuator 212 can be coupled to the internal actuator sleeve 136' in a variety of manners, including, for example, via an actuation shaft 252 that extends from an end of the actuator sleeve 136'. The force provided by the actuator 212 may again be sufficient to at least overcome the biasing force the latch spring 214 as well as to axially displace the actuator sleeve 136' to the second position.

In view of at least the internal positioning of the actuator sleeve 136' shown in FIGS. 9 and 10, and the associated location of the actuation shaft 252, according to certain embodiments, operation of the cam assembly 134', and thus the hammer 140', may utilize a gear reduction system that is different than that used for embodiments similar to that shown in FIGS. 7 and 8. For example, in view of the internal location of at least the actuator sleeve 136', rather than utilizing a planetary gear system, according to certain embodiments, the cam assembly 134' may utilize an external gear 254, including, for example, a helical or spur gear, that can be integral, or otherwise coupled, to the cam assembly 134'. As shown, according to such embodiments, the gear 254 can be configured to directly, or indirectly via other gears, engage the mating ring gear 116.

As seen in FIG. 10, when the actuator sleeve 136' is at the second position the recess 224' of the actuator sleeve 136' can at least initially be aligned with the orifices 248 in the camshaft 152', as well as the hammer groove 202'. Such alignment can accommodate the portion of the latching bodies 144 in the hammer groove 202' being removed from the hammer groove 202', and a portion of the latching bodies 144 instead being displaced into the adjacent recess 224' in the actuator sleeve 136'. Moreover, the latching bodies 144 can be urged out, and/or away, from the hammer groove 202' such that the hammer 140' can be released from the latched position. Such urging of the latching bodies 144' can be achieved in a variety of manners. For example, according to the illustrated embodiment, the biasing element 138 of the impact latch assembly 102' can provide a force that at least axially urges the hammer 140' toward the anvil 142. Such force, as well as the shaped of the hammer groove 202', such as, for example, a curved shape that generally conforms to at least a portion of an outer curved or rounded shape of the adjacent portion of the latching bodies 144, can facilitate the latching bodies 144 being pushed out from the hammer groove 202' as the hammer groove 202' is being axially displaced toward the anvil 142. The hammer can then be both rotatably and axially displaced to the impact positon, at which the hammer jaws 192' can impact the anvil jaws 208. Further, with the hammer 140' at, or moving towards, the impact positon, the body portion 190' of the hammer 140' can be positioned so as to at least assist in retaining the latching bodies 144 within at least the orifice 248 of the camshaft 152' and the recess 224' of the actuator sleeve 136'.

Following the hammer jaws 192' impacting the anvil jaws 208, the rebound energy can, as previously discussed, cause the hammer 140' to be rotated in an opposite direction, as well as cause the hammer 140' to be axially retracted away from the anvil 142. If the rebound energy is at least sufficient to accommodate the hammer 140' being axially displaced to a location at which the hammer groove 202' is again aligned with the orifices 248 in the camshaft 152', if not in excess of such energy, the hammer 140' can again return to the latched position. Moreover, upon the hammer groove 202' returning to a position at which the hammer groove 202' is generally aligned with the orifices 248 of the camshaft 152', the shape and configuration of the recess 224' of the actuator sleeve 136' can, as the biasing force of the latch spring 214 facilitates axial displacement of the actuator sleeve 136' back to the first position, result in the actuator sleeve 136' pushing or otherwise linearly displacing at least a portion of the latching bodies back into the hammer groove 202'. With the latching bodies 144 partially in the hammer groove 202' so as to provide an interference that prevents movement of the hammer 140', the actuator sleeve 136' can again be at a position at which the portion of the actuator sleeve 136' that is adjacent to the orifices 248 in the camshaft 152' assists in preventing the latching bodies 144 from being removed from the hammer groove 202', and thereby assist in retaining the hammer 140' in the latched position.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. An apparatus comprising:

a hammer having a hammer groove, the hammer being axially and rotatably displaceable along a cam shaft between a retracted position and an impact position;

an anvil positioned to be impacted by the hammer when the hammer is displaced to the impact position;

one or more latching bodies, a first portion of the one or more latching bodies being positioned within the hammer groove when the hammer is at the retracted position, the one or more latching bodies not being positioned within the hammer groove when the hammer is at the impact position;

an actuator sleeve having an outer wall surrounding at least a portion of the hammer, the actuator sleeve having a recess and being displaceable between a first position and a second position, the actuator sleeve configured to retain at least the first portion of the one or more latching bodies within the hammer groove when the actuator sleeve is at the first position, the recess positioned to accommodate removal of the first portion of the one or more latching bodies from the hammer groove when the actuator sleeve is at the second position; and a biasing element and an actuator, the biasing element configured to provide a biasing force to bias the actuator sleeve to the first position, the actuator coupled to the actuator sleeve and selectively operable to displace the actuator sleeve from the first position to the second position.

2. The apparatus of claim 1, further including a control system having a position sensor and a timer, the control system being communicatively coupled to the actuator and configured to generate, in response to at least information provided by the position sensor and the timer, a command for the actuator to displace the actuator sleeve to the second position.

3. The apparatus of claim 2, wherein the position sensor detects an angular position of the hammer, and wherein information provided by the position sensor and the timer is used to determine a rotational velocity of the hammer.

4. The apparatus of claim 1, wherein the hammer groove extends around an external surface of the hammer, and further including a cam assembly having the cam shaft and a cam sleeve, the cam sleeve having an orifice, at least a second portion of the one or more latching bodies being positioned in the orifice when the hammer is at both the retracted position and the impact position.

5. The apparatus of claim 1, wherein the cam shaft includes at least one helical groove, and further including at least one cam ball, the at least one cam ball positioned in a recess in the hammer and extending into the at least one helical groove, and wherein axial and rotational displacement of the hammer along the cam shaft is guided at least in part by displacement of the at least one cam ball along the at least one helical groove.

6. An apparatus comprising:

one or more latching bodies;

a hammer having a hammer groove and one or more hammer jaws, a first portion of the one or more latching bodies being selectively received within, and removed from, the hammer groove;

an anvil having one or more anvil jaws;

an actuator sleeve having an outer wall surrounding at least a portion of the hammer, the actuator sleeve being axially displaceable between a first position at which the actuator sleeve assists in retaining the first portion of the one or more latching bodies in the hammer groove and a second position at which the actuator sleeve accommodates removal of the first portion of the one or more latching bodies from the hammer groove, wherein the hammer is axially displaceable between an impact position at which the hammer impacts the anvil and a latched position at which the hammer is axially retracted from the anvil, wherein the first portion of the one or more latching bodies is removed from the hammer groove in the impact position and the first portion of the one or more latching bodies is received in the hammer groove when the hammer is in the latched position; and a biasing element and an actuator, the biasing element configured to provide a biasing force to bias the actuator sleeve to the first position, the actuator coupled to the actuator sleeve and selectively operable to displace the actuator sleeve from the first position to the second position.

7. The apparatus of claim 6, further including a cam assembly comprising a cam shaft and a cam sleeve, the hammer being both axially and rotatably displaced along at least a portion of the cam shaft between the impact position and at least the latched position, the cam sleeve having an orifice that houses at least a second portion of the one or more latching bodies, the orifice positioned for alignment with the hammer groove when the hammer is at the latched position.

8. The apparatus of claim 7, wherein a latching body of the one or more latching bodies is received in the hammer groove and the orifice when the hammer is at the latched position, and further wherein at least the first portion of the one or more latching bodies are in the orifice and not in the hammer groove when the hammer is at the impact position.

9. The apparatus of claim 7, wherein the hammer groove is shaped to urge displacement of the first portion of the one or more latching bodies out from the hammer groove when the hammer is released from the latched position.

10. The apparatus of claim 6, further including a cam shaft, the hammer being both axially and rotatably displaced along at least a portion of the cam shaft between the impact position and at least the latched position, and wherein a latching body of the first portion of the one or more latching bodies is received in the hammer groove and received in an orifice of the cam shaft when the hammer is at the latched position, and further wherein at least the first portion of the one or more latching bodies is in the orifice and not in the hammer groove when the hammer is at the impact position.

11. The apparatus of claim 6, further including a control system a position sensor and a timer, the control system being communicatively coupled to the actuator that is coupled to the actuator sleeve, the control system configured to generate, based at least in part on information from the position sensor and a derived velocity of the hammer, a command for the actuator to displace the actuator sleeve to the second position.

12. The apparatus of claim 11, wherein the position sensor detects information relating to an angular position of the hammer, and wherein the derived velocity of the hammer is calculated using the information detected by the position sensor and provided by the timer.

13. An apparatus comprising:

a hammer having a hammer groove disposed about an internal portion of the hammer, the hammer being axially and rotatably displaceable along a cam shaft between a retracted position and an impact position;

an anvil configured to be impacted by the hammer when the hammer is displaced to the impact position;

a latching body, the latching body being positioned within the hammer groove when the hammer is at the retracted position, the latching body being removed from within the hammer groove when the hammer is at the impact position, wherein the cam shaft includes an orifice that receives the latching body when the hammer is at both the retracted position and the impact position; and an actuator sleeve having a recess and being displaceable between a first position and a second position, the actuator sleeve configured to retain the latching body within the hammer groove when the actuator sleeve is at the first position, the recess positioned to accommodate removal of the latching body from the hammer groove when the actuator sleeve is at the second position.

14. The apparatus of claim 13, wherein at least a portion of the actuator sleeve is displaced between the first position and the second position within a bore of the cam shaft.

15. The apparatus of claim 13, further comprising at least one cam ball, the at least one cam ball positioned in a recess in the hammer and extending into a helical groove disposed in the cam shaft, wherein axial and rotational displacement of the hammer along the cam shaft is guided at least partially by displacement of the at least one cam ball along the one helical groove.

16. The apparatus of claim 13, further comprising a biasing element and an actuator, the biasing element configured to provide a biasing force to bias the actuator sleeve to the first position, the actuator coupled to the actuator sleeve and selectively operable to displace the actuator sleeve from the first position to the second position.

17. The apparatus of claim 16, further including a control system having a position sensor and a timer, the control system being communicatively coupled to the actuator and configured to generate, in response to at least information provided by the position sensor and the timer, a command for the actuator to displace the actuator sleeve to the second position.

* * * * *